United States Patent [19]

Cailloux

[11] 4,098,109

[45] Jul. 4, 1978

[54] BENDING PRESS OR SIMILAR MACHINE TOOL

[75] Inventor: Paul Cailloux, La Varenne Saint Hilaire, France

[73] Assignee: Promecam Sisson-Lehmann, Saint-Denis, France

[21] Appl. No.: 782,833

[22] Filed: Mar. 30, 1977

[30] Foreign Application Priority Data

Apr. 13, 1976 [FR] France ..... 76 10806

[51] Int. Cl.[2] ..... B21D 5/02

[52] U.S. Cl. ..... 72/389; 72/465; 100/258 A

[58] Field of Search ..... 267/119, 130; 100/258 R, 258 A; 72/389, 465

[56] References Cited

U.S. PATENT DOCUMENTS 2,848,034 8/1958 Ernst ..... 100/258 A 3,587,286 6/1971 Fritsch ..... 72/389

3,914,975 10/1975 Kawano ..... 100/258 A

*Primary Examiner*—Lowell A. Larson

*Attorney, Agent, or Firm*—Michael J. Striker

[57] ABSTRACT

This bending press or similar machine tool comprising a top beam and a bottom beam disposed on either side of a working bed and provided with matching tools, respectively, one beam bearing with its ends on the fixed frame structure of the machine while the other is movable and actuated by driving members located at its ends; one beam comprises two sections one of which is supported or actuated at either end while the other section is connected to the first section by means of one or two common studs disposed symmetrically in relation to the transverse median place of the beam and relatively close to said plane; one section of the compound beam comprises a pair of panels disposed on either side of a panel constituting the other section.

16 Claims, 13 Drawing Figures

BENDING PRESS OR SIMILAR MACHINE TOOL

BACKGROUND OF THE INVENTION

1. Field of the Invention

This invention relates in general to bending presses or similar machine tools comprising two beams overlying each other in substantially co-planar relationship and disposed on either side of the working bed, one beam being fixed and the other vertically movable.

2. Description of the Prior Art

In the case of a bending press, one beam carries the punch and the other beam carries the die of the bending tool.

However, to bend sheet plate while maintaining a constant angle throughout the length of the fold, the punch must engage the die to the same extent or depth throughout its length. Now, this penetration is controlled inter alia by the following parameters:

on the one hand, the position of the movable beam in relation to the fixed beam at the end of the bending operation, this position determining the average angle of the fold, and on the other hand, the difference between the distortions of the two beams, which gives the angular variations about the average angle, thus involving a lack of precision.

The main difficulty is due to the fact that the sheet metal reacts on both beams with uniformly distributed forces exerted in opposite directions. Now, in bending presses or similar machines wherein the fixed beam is supported at its ends, in contrast to the movable beam actuated by driving members also located at its ends, the working edges of the two beams are flexion-stressed in opposite directions. As a result, considerable irregularities or unevennesses are observed along the fold.

To avoid this serious inconvenience, the movable beam of certain known presses is actuated either by a single hydraulic cylinder disposed in the transverse median plane of the beam, or by a plurality of cylinders disposed symmetrically in relation thereto. Thus, a central thrust can be exerted on the movable beam, so that the flexion of the registering edges of the two beams takes place in the same direction. Consequently, a compensation is obtained between the distortions of both beams, so that the above-mentioned inconveniences can be at least partially avoided. However, though this solution is very advantageous in comparison with the first type of machine mentioned hereinabove, it is objectionable in that it gives different distortion curves between the working edges of the two beams. This is due to the difference arising in the distribution of the applied efforts.

Moreover, in the case of hydraulic balance means, this solution makes it necessary to provide at the ends of the movable beam a pair of balancing hydraulic cylinders having a crossed interconnection. The only function of these cross-connected cylinders is to exert a parallel guiding action on the movable beam, irrespective of the distribution of overhanging bending forces, these cylinders playing no part in the sheet bending operation.

DESCRIPTION OF THE INVENTION

It is therefore the primary object of the present invention to provide a bending or folding press, or similar machine tool, wherein the distortion curves of the working edges of the fixed and movable beams are as far as possible equal to each other, and wherein the fixed beam bears with its ends on the fixed main frame structure, the movable beam being also actuated by driving members disposed at the ends of the movable beam. In a press of this type, one beam is made of two sections, one section being supported or actuated at either end while the other section is connected to said first section through the medium of one or two common axes disposed symmetrically in relation, and relatively close to, the transverse median plane of the beams.

Under these circumstances, as will be explained presently, distortion curves as close as possible to each other are obtained for the two working edges of the fixed and movable beams. Therefore, a practical solution is thus brought to the problem set forth hereinabove, by using extremely simple means.

According to another feature characterizing this invention, the two-section beam of the press comprises pre-stressing means located at the ends thereof whereby the active portion of this beam, i.e. the portion carrying the corresponding tool, can be given initially a distortion in the same direction as, and parallel to, the distortion to which the other beam is subjected when the bending stress is applied thereto.

However, other features and advantages of the present invention will appear as the following description proceeds with reference to the attached drawings, in which:

DESCRIPTION OF THE PREFERRED EMBODIMENTS

To facilitate the understanding of the mode of operation of the bending press according to this invention, a brief description of the mode of operation of the hitherto known bending presses mentioned hereinabove will first be given.

Figure 1:
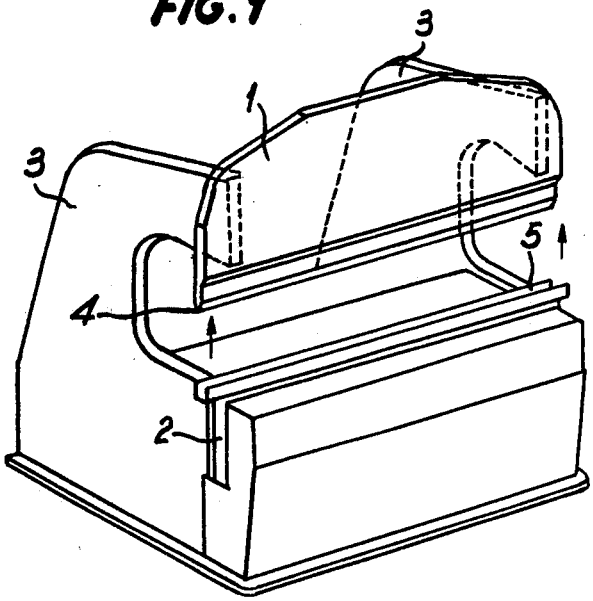
FIG. 1 is a perspective view of a bending press of a known type.

As illustrated in FIG. 1, these known presses comprise a pair of vertical, top and bottom beams 1 and 2 disposed on either side of the working plane, one beam being fixed and the other movable in a vertical plane.

In the example illustrated, the top beam 1 is fixed and its ends are rigid with a pair of gooseneck shaped side plates or brackets 3. The corresponding fixed bearings are shown only diagrammatically in FIG. 3 as having a knife-edge configuration A. The bottom beam 2 is driven by a pair of hydraulic or fluid-actuated cylinders disposed adjacent its ends and designated diagrammatically by a pair of arrows V in FIG. 3. The working edges of these two beams are equipped with a bending punch 4 and a matching die 5, respectively.

Figure 2:
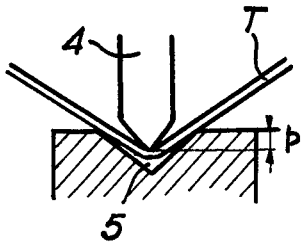
FIG. 2 is a diagrammatic sectional view illustrating the manner in which the press tool works during a bending operation.

As illustrated in FIG. 2, the bending angle of a sheet-iron or other plate T to be bent depends on the depth of penetration *p* of the punch 4 into the die 5. To obtain a fold having a constant angular value throughout its length, this penetration must obviously have the same depth from one to the other end of the fold.

Figure 3:
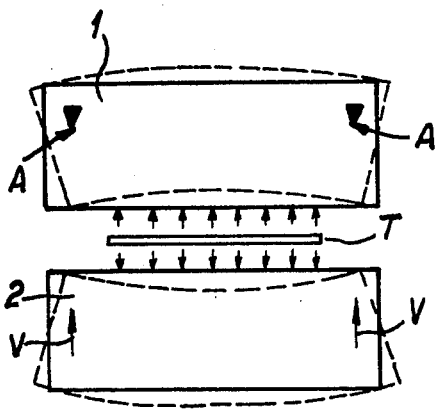
FIGS. 3 and 4 are diagrammatical front elevational views showing two different and presently known types of bending presses.

In the case of a press of known type such as illustrated diagrammatically in FIGS. 1 and 3, this arrangement is not applicable. In fact, as shown in dash lines in FIG 3, the working edges of both beams are caused to yield in opposite directions under the reaction forces of the sheet T, which are exerted on these two edges. This is due to the localization of bearing points A and also of the thrust points V in the vicinity of the two ends of the beams.

Figure 4:
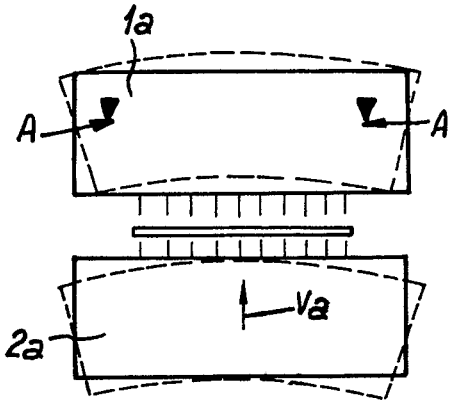

To prevent the working edges of the beams from yielding in opposite directions, the press shown diagrammatically in FIG. 4 comprises a so-called "central thrust" driving system. In this case a central cylinder Va disposed in the central median plane is substituted for the pair of end cylinders V, the fixed top beam still comprising two bearing points A located adjacent its ends.

In this case the distortions of the working edges of the two beams 1*a* and 2*a* take place in the same direction, as shown in dash lines. However, the curves corresponding to the distortions of the edges of both beams differ from each other due to the different distribution of the applied efforts.

Figure 6:
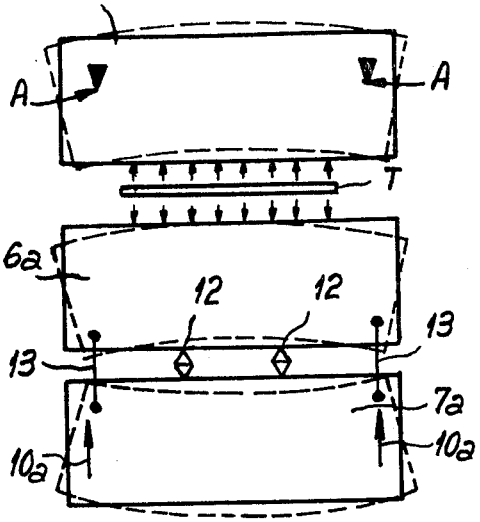
FIGS. 5 and 6 are similar diagram illustrating the conception and principle of operation of the presses according to the instant invention.
Figure 5:
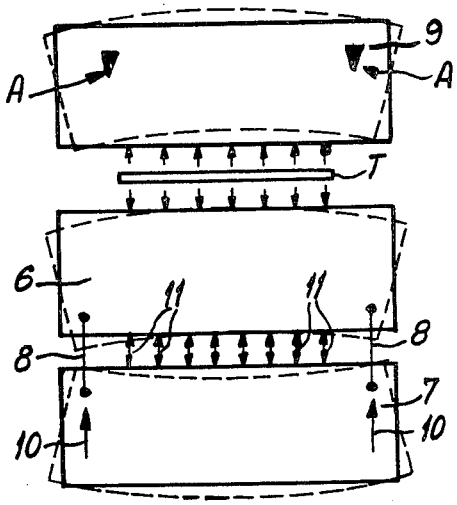

FIGS. 5 and 6 illustrate diagrammatically the basic or theoretical principle of the bending presses according to this invention. It will be seen that the essential feature characterizing this improved press lies in the fact that one of the two beams is divided into two sections interconnected at their ends, and that suitable means are provided for exerting between these two sections a uniformly distributed force equal to twice the bending force. Therefore, with this arrangement the distribution of the efforts exerted on the operative section of this beam is exactly equivalent to the efforts exerted on the other beam.

This advantageous solution is illustrated diagrammatically in FIG. 5 showing a press wherein the bottom movable beam comprises two separate sections 6 and 7 having their ends interconnected by a pair of tie-rods 8, the fixed top beam 9 consisting as before of a single member and having two bearing points A located at its ends. The bottom beam 6, 7 is driven by means of a pair of hydraulic cylinders 10 acting on both ends of the lower section 7 thereof.

Each cylinder 10 is adapted to exert a thrust corresponding to one-half of the bending force F. Moreover, there are provided between the two sections 6 and 7 of the bottom beam a plurality of hydraulic cylinders or like actuators 11 shown only diagrammatically in the form of double-headed arrows. These last-mentioned cylinders are capable of exerting on the active section of the bottom beam a vertical upward force 2F not used for the bending operation but effective on a length equal to the length of the sheet or plate to be bent.

Thus, the upward vertical force exerted on the active section 6 of the beam is equal to 2F — F, and therefore to F, whereby the upper free edge of this active section undergoes exactly the same distortion as the lower edge of the fixed top beam 9 responsive to the reaction force F exerted thereon by the sheet or plate T during the bending operation.

FIG. 6 illustrates a simplified embodiment of the above-defined solution. In this case, the intermediate cylinders 11 previously disposed between the two sections 6 and 7 of the compound beam are replaced by one or two fixed blocks 12. On the other hand, connecting members 13 capable of exerting a prestress between the two sections 6*a* and 7*a* of the bottom beam are substituted for the tie-rods 8. This arrangement also permits of obtaining substantially identical distortion curves for the working edge of the active section 6*a* of the bottom beam and for the registering edge of the fixed top beam 9*a*.

FIGS. 7 to 10 illustrate a practical embodiment of a press constructed according to the teachings of the present invention. In this modified structure, the two sections of the bottom compound beam are not disposed in superposed relationship but somewhat in sandwich fashion. In fact, the active section of the bottom compound beam consists of a pair of vertical panels 6*b* disposed on either side of another vertical panel 7*b* constituting the other section of the same beam.

The upper working bar 14 of this beam is rigid with the upper edges of the pair of panels 6*b*, and the central panel 7*b* bears at its ends on a pair of thrust cylinders 10*b* underlying its lower edge.

Figure 7:
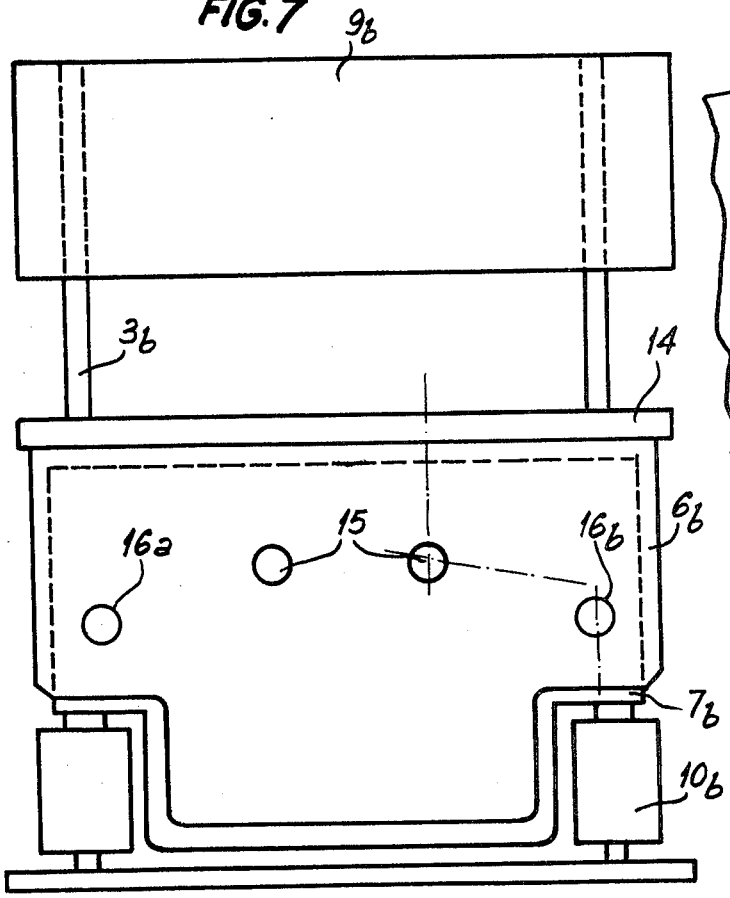
FIG. 7 is a diagrammatic front elevational view of a typical form of embodiment of a bending press according to this invention.
Figure 8:
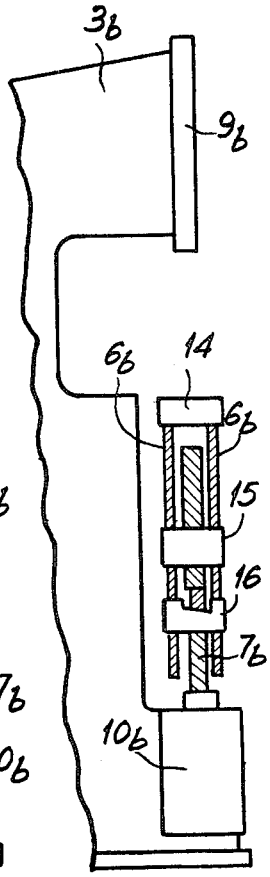
FIG. 8 is a vertical section taken along the line VIII—VIII of FIG. 7.
Figure 10:
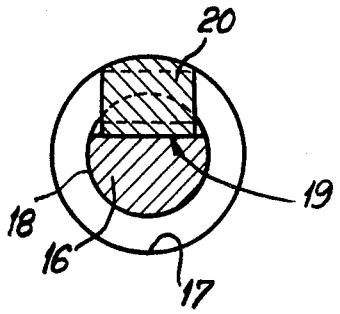
FIG. 10 is a fragmentary section taken along the line X—X of FIG. 9.
Figure 9:
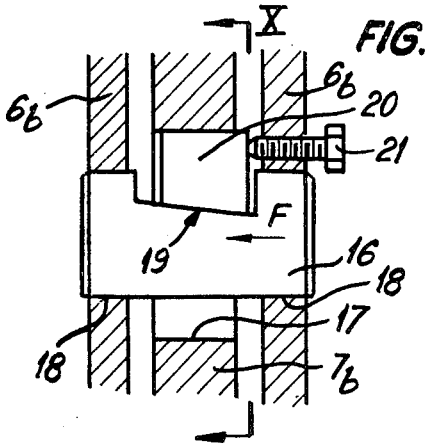
FIG. 9 is a section taken along the line IX—IX of FIG. 7, showing a detail on a different scale.

The two panels 6*b* of the active section of this beam are secured to the central panel 7*b* by means of one or two studs 15. The studs 15 shown in FIG. 7 are disposed symmetrically on either side of, and relatively close to the transverse median plane VIII—VIII of the press. In the attached drawings, these studs are cylindrical, but of course other cross-sectional shapes may be contemplated, if desired.

The bottom compound beam of this press also comprises means capable of exerting a prestress between its two component sections at two points located in close vicinity of the two ends of this beam. For this purpose, in the example illustrated two mechanical prestress systems are provided, each system comprising a transverse stud 16 engaging with a suitable clearance a bore 17 formed in the central panel 7*b* but having its ends fitted relatively tightly in aligned bores 18 formed in the two external panels 6*b* of the active section of the beam.

In its intermediate portion this stud 16 has an inclined notch cut therein to provide an inclined surface 19 engaged by a sliding wedge 20 adapted to be pushed more or less by means of a screw 21. On its contact surface this wedge has a plane of same inclination as said face 19. However, on its opposite surface, this wedge 20 is shaped to match the registering portion of bore 17.

Thus, when the wedge 20 is pushed in the direction of the arrow F by means of said screw 21, a certain prestress is created between the two component sections of the bottom beam, which tends to impart to the upper bar 14 of this beam a distortion curve having the same direction as the curve of the lower edge of the top fixed beam 9*b* of the corresponding press when this upper fixed beam 9*b* is stressed by reaction forces during the bending operation. Moreover, the distortion thus imparted to the bar 14 is substantially parallel to that applied to the lower edge of beam 9b during the bending operation.

It may be noted that the prestress exerted between the two sections of the composite beam can be adjusted at will when the machine is under operating pressure. In fact, the natural flexion of the bottom beam relieves the stress resulting from the application of each wedge 20 against the inclined face 19 of the corresponding stud 16. Consequently, the two prestress systems designated by the general reference numerals 16a and 16b may be adjusted or set for different load values to take due account of a possible offsetting of the sheet to be bent.

However, the essential advantage deriving from the present invention lies in the fact that the original conception of the press constructed according to the teachings of this invention affords a greater degree of precision and uniformity in the fold angle in comparison with the properties obtained in the case of a so-called "central thrust" press, i.e. a press of the type shown diagrammatically in FIG. 4 in which the movable beam is actuated by a hyraulic cylinder disposed at the centre thereof.

Now this advantageous result is obtained with a press comprising only two fluid-actuated cylinders disposed at either end of the movable beam, whereas in so-called "central thrust" presses complementary balancing cylinders must be provided adjacent the beam ends in addition to the central cylinder or cylinders.

Figure 11:
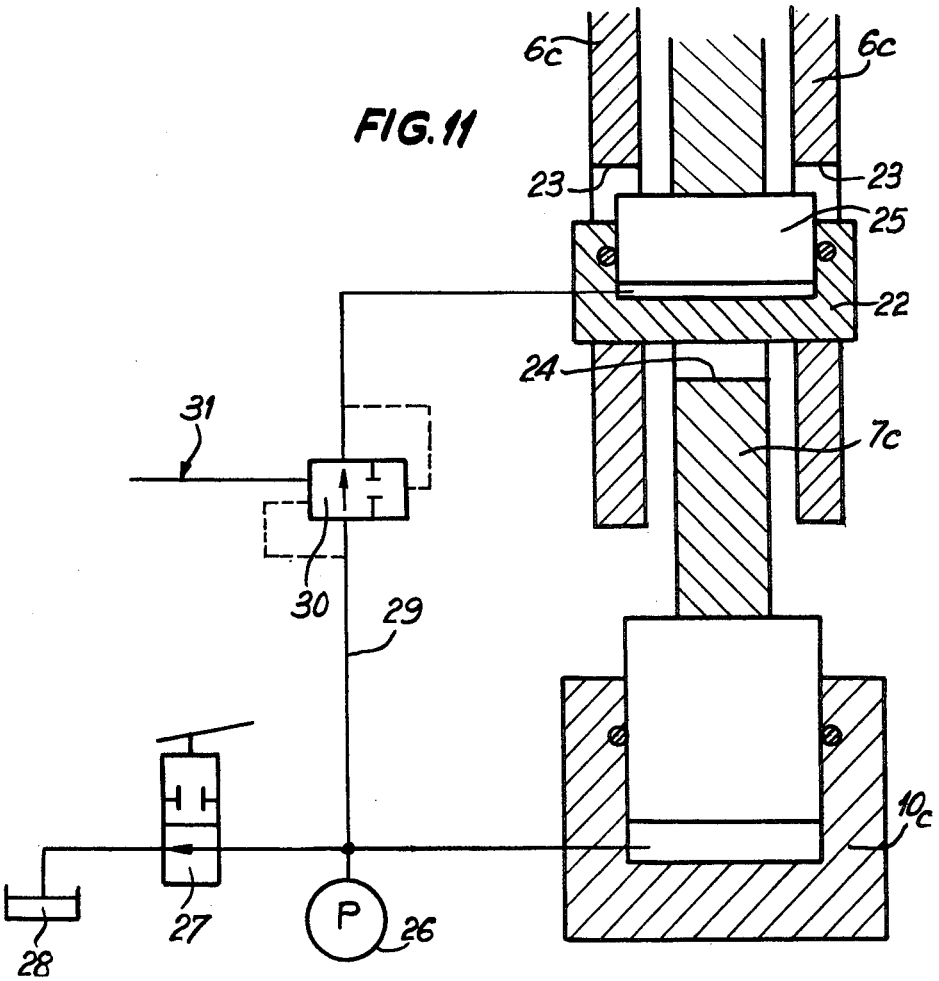
FIG. 11 is a diagrammatic and fragmentary cross section showing a modified embodiment of the bending press according to this invention.

Of course, the prestress means provided between the two sections constituting the compound beam of the press according to this invention may be replaced if desired by other adequate systems capable of producing said prestress. However, FIG. 11 of the attached drawings illustrates another possible embodiment of the press according to this invention. This embodiment is applicable to presses actuated by hydraulic cylinders. The structure of this specific press is such that the pressure of the control fluid is utilized for causing the active section of the compound beam to yield in the desired direction during the bending operation.

For this purpose, hydraulic cylinders 22 are substituted for the wedge-type prestress means 16a and 16b contemplated in the preceding form of embodiment.

The body of each cylinder 22 extends through apertures 23 and 24 registering with each other and formed in the panels 6c constituting the active section of the beam, and also in the central panel 7c constituting the other section thereof. Each cylinder body reacts downwards by bearing against the corresponding lower edge of the apertures 23 of the external panels 6c. The piston 25 of each cylinder is adapted to exert an upward pressure against the edge of the aperture 24 formed in the central panel 7c.

As in the preceding case, the central panel 7c bears with its ends against a pair of working cylinders 10c. In the present example these cylinders are of the hydraulic type connected to a control circuit comprising a pump 26, a distributor 27 and a reservoir 28. The pump 26 delivers fluid under pressure to the pair of working cylinders 10c when the pipe line leading to the reservoir 28 is shut off by distributor 27.

However, this pump is also connected to the pair of prestress cylinders 22 via another pipe line 29 comprising a pressure reducing device 30. The proportionality constant of this pressure reducing device 30 is adjustable by known means, not shown, which acts through another pipe line 31.

The aforesaid adjusting means may be either manual or automatic, and adapted to operate as a function of the length of the sheet to be bent. In the case of an automatic device it is only necessary to detect the length of sheet T engaged between the two beams, by means of known devices such as photocells, proximity switches, feelers, etc. connected to the adjustment means connected via pipe line 31. Thus, for a given length of sheet T, the proportionality constant is invariable. Therefore, the pressures in cylinders 10c and 22 are in constant ratio to each other.

However, when the sheet length varies, this ratio changes in order to harmonize the flexion of the working bar 14 of the bottom beam with that applied to the working edge of the top beam as a consequence of the bending effort.

It is clear that by applying the principles of the present invention it is possible to construct a press either with a rising bottom beam (as illustrated by way of example in FIGS. 7, 8 and 11) or with a descending upper beam, without modifying the mode of operation and by utilizing similar component elements, except for some minor changes.

Figure 12:
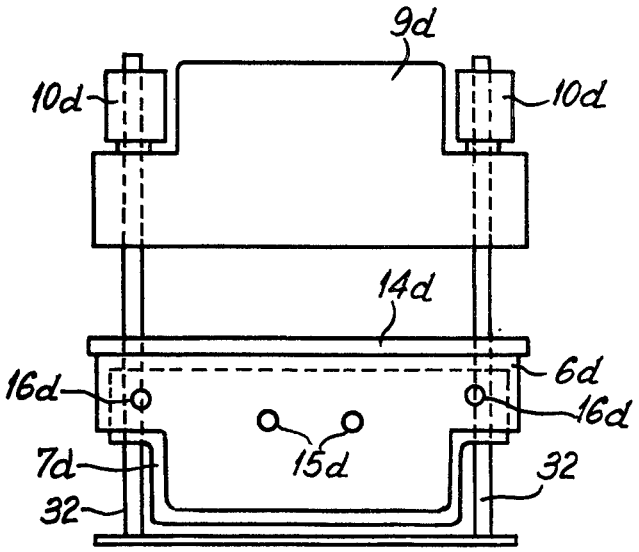
FIGS. 12 and 13 are front elevational views of two other forms of embodiment of the bending press according to the present invention.

FIG. 12 illustrates a modified embodiment in which the top beam 9d is adapted to be lowered by means of a pair of working cylinders 10d mounted at the ends of this beam. The bottom beam is fixed and comprises as in the preceding example of two sections assembled to each other and comprising prestressing means therebetween. One of these two sections consists of a central vertical panel 7d bearing with its ends against a pair of fixed abutment members 32. The active section of this beam consists of a pair of vertical panels 6d disposed on either side of said central panel 7d and carrying at their upper portions the corresponding working bar 14d. These three panels are assembled by means of one or two studs 15d disposed symmetrically on either side of, and relatively close to, the transverse median plane. Besides, these panels are also interconnected by means of prestress means 16d operating mechanically, hydraulically or otherwise.

Thus, as in the preceding examples, substantially identical distortions of the working edges of the fixed and movable beams may be obtained.

Figure 13:
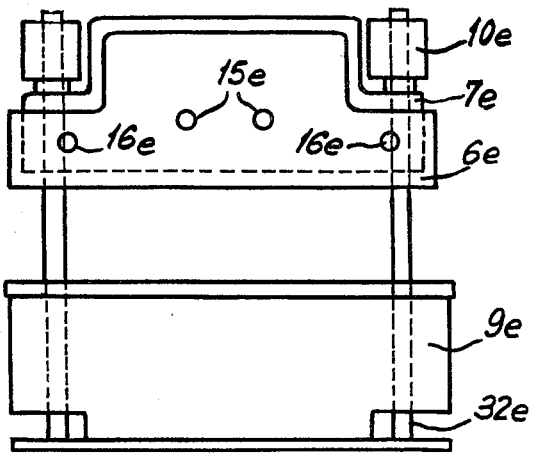

In the various forms of embodiment described hereinabove with reference to the attached drawing the compound beam of the press is disposed in the lower portion of the press. However, it would not constitute a departure from the basic principles of the invention to mount this compound beam in the upper portion of the press. As illustrated in FIG. 13, in this case the compound beam may be adapted to perform its operative stroke downwardly, as in the case of the preceding example illustrated in FIG. 12. The two sections of this beam consist in this case of a pair of external panels 6e for the active section and a central panel 7e for the other section, the latter bearing with its ends against a pair of driving cylinders 10e. The two sections of this beam are interconnected as in the preceding example by one or two studs 15e and a pair of prestress means 16e. The bottom apron 9e of this press is fixed and bears against a pair of abutment members 32e.

However, it is also possible to contemplate a fixed compound beam at the upper portion of the press and a movable, one-piece bottom beam.

Finally, it may be reminded that the teachings of the present invention are applicable not only to bending presses but also to machine tools of very different character comprising likewise a fixed beam and a movable beam, disposed on either side of a working bed or plane.

I claim:

1. A machine tool of the type comprising a top beam and a bottom beam superposed to each other, and provided each with a tool, one said beam being fixed and the other movable, the fixed beam bearing with its ends on the frame structure of the machine while the movable beam is operatively connected to driving members disposed at either end thereof, wherein one of said beams is a compound beam comprising two sections, namely a section supported at either end and another section provided with the corresponding tool and connected to said first section by means of at least one common stud disposed symmetrically in relation to the transverse median plane of the beams and relatively close to said plane.

2. A machine tool as recited in claim 1, wherein one of said two sections of said compound beam comprises a pair of panels disposed on either side of a third panel constituting the other section thereof.

3. A machine tool as recited in claim 2, wherein said compound beam further comprises a pair of prestress means located at either end of the beam and adapted to put said two beam sections in a state of mutual prestress by imparting to the active section of said beam a distortion of same direction, as and substantially parallel to, the distortion of said other beam when a bending effort is exerted thereon.

4. A machine tool as recited in claim 3, wherein said two prestress means provided between the two sections of said compound beam consist each of an adjustable wedge system adapted to act upon said two sections.

5. A machine tool as recited in claim 3, wherein said two prestress means provided between said two sections of said compound beam comprise a pair of hydraulic cylinders adapted to act upon said two sections and to exert a force proportional to the bending force, the proportionality ratio being subordinate to the lenght of the fold to be obtained in the sheet-metal workpiece.

6. A machine tool as recited in claim 5, wherein means capable of detecting the lenght of the sheet-metal workpiece to be bent and to control a pressure reducing device incorporated in the hydraulic circuit of the machine are provided for setting the proportionality ratio between the effort of the prestress cylinders and the bending force.

7. A bending press comprising:

a fixed elongated bending beam having a center and a pair of ends;

a fixed bending tool carried on said fixed bending beam and extending generally parallel therealong;

a pair of stationary supports each at a respective end of said fixed beam;

a displaceable elongated bending beam generally parallel to said fixed beam and transversely displaceable relative thereto;

a displaceable bending tool carried on said displaceable bending beam, extending generally parallel therealong, and engageable with said fixed bending tool, one of said beams being constituted by first and second beam elements each having a center and a pair of ends;

link means rigidly transversely interconnecting said centers of said beam elements for preventing relative transverse movement therebetween;

a pair of biasing means each between a respective end of said first beam element and the corresponding end of said second beam element for urging the respective element ends together and thereby bowing at least one of said elements; and a pair of actuator means each engaging said ends of the other beam element for pressing said one beam toward said other beam and thereby pressing said tools together.

8. The press defined in claim 7 wherein said link means includes a pair of links symmetrically flanking a central point equidistant between said ends of said elements.

9. The press defined in claim 8 wherein said one beam element includes a pair of spaced-apart parallel plates carrying the respective bending tool, said other beam element being another plate between said parallel plates and connected to said actuator means.

10. The press defined in claim 9 wherein said links are pins extending substantially perpendicularly through and bearing transversely on said plates.

11. The press defined in claim 10 wherein said biasing means each include at least one wedge effective between said plates to urge the respective beam ends together.

12. The press defined in claim 10 wherein said biasing means each include at least one hydraulic cylinder effective between said plates to urge the respective beam ends together.

13. The press defined in claim 10, further comprising means for measuring the width of a workpiece between said tools and for pressurizing said cylinders in accordance with the measured width.

14. The press defined in claim 7 wherein said one beam is said fixed beam.

15. The press defined in claim 7 wherein said one beam is said displaceable beam.

16. The press defined in claim 7 wherein said beams are vertically spaced.

* * * * *